US005559296A

United States Patent [19]

Yamashita

[11] Patent Number: 5,559,296

[45] Date of Patent: Sep. 24, 1996

[54] SNARE DRUM HAVING PARALLEL SNARES UNIFORMLY MOUNTED BY PARALLEL, CLOSELY-SPACED STRAINERS

[75] Inventor: Toshinori Yamashita, Hamamatsu, Japan

[73] Assignee: Yamaha Corporation, Hamamatsu, Japan

[21] Appl. No.: 217,671

[22] Filed: Mar. 25, 1994

Related U.S. Application Data

[63] Continuation-in-part of Ser. No. 67,484, May 26, 1993, abandoned, which is a continuation of Ser. No. 793,810, Nov. 18, 1991, abandoned.

[30] Foreign Application Priority Data

Jun. 6, 1991 [JP] Japan ..... 3-135162

[51] Int. Cl.[6] ..... G10D 13/02

[52] U.S. Cl. ..... 84/415

[58] Field of Search ..... 84/415, 416, 417

[56] References Cited

U.S. PATENT DOCUMENTS

| | | | |
|---|---|---|---|
| 365,817 | 7/1887 | Johnson | 84/415 |
| 1,653,570 | 12/1927 | Howe | 84/415 |
| 2,261,120 | 11/1941 | Ludwig et al. | 84/415 |

FOREIGN PATENT DOCUMENTS

| | | |
|---|---|---|
| 57-100793 | of 0000 | Japan . |
| 55-19995 | 5/1980 | Japan . |
| 63-30895 | 2/1988 | Japan . |

*Primary Examiner*—Cassandra C. Spyrou
*Attorney, Agent, or Firm*—Loeb & Loeb LLP

[57] ABSTRACT

A snare drum is disclosed having a drum body, upper and lower drum heads fitted over openings formed at upper and lower ends of the drum body, and upper and lower rims, each of which engages peripheral edges of the upper and lower drum heads. Multiple lugs are arranged around the outer surface of the drum body and multiple nuts connect the upper and lower rims with the multiple lugs so as to pull the upper and lower rims toward one another. Multiple snare strainers on the drum body have a movable section which through the operation of a performer, can be made to operate so as to adjust one of multiple snares attached thereto so as to be moved between a position in contact with a surface of a drum head and a position out of contact with the drum head. Furthermore, bases are provided in proximity to opposite ends of two of multiple lugs which lie on opposite ends of a line segment which approximately superimposes a diameter of the drum body, one of the two lugs being coupled by a first one of multiple nuts to a selected location on the lower rim and the means for mounting being coupled to the selected location on the lower rim by the first one of multiple nuts to generally space the pair of the snare strainers on opposite sides of the one of the two lugs in generally parallel relation to each other.

6 Claims, 8 Drawing Sheets

SNARE DRUM HAVING PARALLEL SNARES UNIFORMLY MOUNTED BY PARALLEL, CLOSELY-SPACED STRAINERS

CROSS REFERENCE TO RELATED APPLICATIONS

This is a continuation-in-part of application Ser. No. 08/067,484, filed May 26, 1993 now abandoned, which is a continuation of application Ser. No. 07/793,810, filed Nov. 18, 1991, now abandoned.

BACKGROUND OF THE INVENTION

1. Field of the Invention

The present invention pertains to snare drums, and more particularly, to snare drums having parallel snares uniformly mounted by parallel, closely-spaced strainers.

2. Description of Related Art

The snare drum is a well-known percussion musical instrument. FIG. 11 illustrates one example of the structure of a conventional snare drum is that disclosed in Japanese Utility Model Application, Second Publication, No. 55-19995. In FIG. 11, the snare drum 1 is viewed obliquely from below, so as to illustrate the snare mechanism thereof at the lower surface and at a portion of the side of the snare drum 1. The snare drum 1 includes a hollow cylindrical drum body 2, upper and lower drum heads 3 fitted over the openings formed at the upper and lower ends of the drum body 2. Upper and lower rims 4 are provided which engage the peripheral edge of the upper and lower drum heads 3, respectively, and which are connected together via multiple lugs 5 arranged around the outer surface of the drum body 2 and a pair of threaded nuts 6 for each lug 5. Each lug 5 is engaged with each nut of its corresponding pair of the nuts 6 by means of a thread around the lug 5 and a threaded hole in the nut 6. By means of this arrangement, each lug 5 and corresponding pair of the nuts 6 act to pull the upper and lower rims 4 toward each other, thereby applying and maintaining centrifugally directed tension to the upper and lower drum heads 3 along the peripheral edges thereof.

The snare drum 1 further includes snares 7 and 8 provided above the outer surface of the lower drum head 3 in FIG. 11. The snares 7 and 8 are each constructed from a snare element 9 or 10, respectively, consisting of multiple parallel strands of gut string or coiled metal wires (snappy wire), a metal retainer 11 at each end of each of the snare elements 9 or 10, and a braid 12 for each metal retainer 11 whereby each metal retainer 11 is connected with the drum body 2 via a corresponding snare strainer 13, respectively.

The two braids 12 at the ends of the snare 7 and those at the ends of the snare 8 each connect with the outer surface of the drum body 2 via the corresponding snare strainer 13 after first passing through a corresponding opening $4_a$ for each provided in the lower rim 4. The snare strainers 13 at the ends of the snares 7 and 8 are each mounted on the side of the drum body 2 at approximately the mid-position between an adjacent pair of the lugs 5, with the lug 5 intervening between the pair of the snare strainers 13 at each side of the snare drum 1. The snare strainer 13 at one or both ends of each of the snares 7 and 8 is further provided with a rotatable lever 14 whereby the position of the snare elements 9 and 10 of the snares 7 and 8, respectively, can each be independently adjusted relative to the outer surface of the lower drum head 3, thereby making it possible to move one or both of the snare elements 9 and 10 into contact with or away from the outer surface of the lower drum head 3. By this means, it is possible to generate two or more different types of sound with the snare drum 1.

When the corresponding levers 14 are rotated so as to move the snare elements 9 and 10 of the snares 7 and 8 into contact with the outer surface of the lower drum head 3, the snare elements 9 and 10 vibrate in unison with the lower drum head 3 causing production of a metallic rattling sound. Conversely, when both of the levers 14 are rotated so as to move the snare elements 9 and 10 away from the outer surface of the lower drum head 3, a normal drum sound is produced. By selecting the multiple strands from which the snare elements 9 and 10 are constructed so that those of the snare element 9 and those of snare element 10 have different diameters and/or physical properties, and/or so that the number thereof is different for the snare elements 9 and 10, different timbres can be achieved depending on whether the snare element 9, the snare element 10, or both, are in contact with the outer surface of the lower drum head 3. By alternatively handling each of the levers 14 on the snare strainers 13, the position of the snare elements 9 and 10 can be independently adjusted, thus making it possible to achieve varying timbres during performance.

With the conventional snare drum 1 as thus described, however, because the snare strainers 13 at the ends of the snares 7 and 8 are each mounted on the side of the drum body 2 at the approximate mid-position between an adjacent pair of the lugs 5, with the lug 5 intervening between the pair of the snare strainers 13 at each side of the snare drum 1, there tends to be a significant gap between the snare elements 9 and 10. For the same reason, a player cannot simultaneously operate both of the levers 14 on both of the snare strainers 13 during performance. In addition, for the same reason, the snare elements 9 and 10 are significantly displaced from the center of the snare drum head 3.

Additionally, because two openings $4_a$ are formed in the lower rim 4 at the approximate mid-position between the adjacent pair of the lugs 5, the flexural rigidity of the lower rim 4 at this position is not good. For this reason, an intervening lug 5 between the snare strainers 13 exerts a different force on the lower and upper rims 4 than do the other lugs 5. Accordingly, accurate adjustment of the tension applied to the drum heads 4 so as to achieve uniform tension around the snare drum 1 is very difficult. Consequently, the sound produced by each such snare drum 1 is likely to differ from that produced by other seemingly identical drums. Additionally, the clarity and sharpness of sound which is desirable for snare drums is not readily achieved.

Furthermore, in the conventional snare drum 1, because the snare strainers 13 are not symmetrical with respect to an intervening lug 5 as shown in FIG. 11, the snares 7 and 8 are not symmetrical with respect to an intervening diameter of the drum head 3. Additionally, the snare strainers 13 are mounted directly on the drum body 2. This places the snare strainers 13 at an angle relative to each other and to the snares 7 and 8. Consequently, the braids 12 extending from the metal retainers 11 at the ends of the snares 7 and 8 must extend at angles relative to the snares 7 and 8 and through the openings $4_a$ in the rims 4 to the snare strainer 13. A further problem arises from the fact that the snares 7 and 8 are not equidistantly spaced from an intervening diameter of the lower drum head 3. Consequently, the lengths of the braids 12 are different, as are the angles of attachment to the snare strainers 13. Accordingly, because of the consequent differing spatial relation between the snare strainers 13 for the snare 7 or 8 lying closer to a diameter of the drum body 2 and those for the snare 7 or 8 lying relatively farther from the same diameter of the drum body 2, the angles formed between two of the snare strainers 13 and their corresponding snare element 9 or 10, and the angles formed between the other two snare strainers 13 and their corresponding snare element 9 or 10 are different. Consequently, the effect of operation of the levers 14 on different snare strainers 13 are likely to differ in terms of movement of the snare elements 9 and 10 away from or toward the surface of the lower drum head 3. Thus, even and reproducible adjustment of the position of the snare elements 9 and 10 is difficult to achieve. For this reason, it is difficult to insure that the snare element 9 or 10 is fully in contact with the surface of the lower drum head 3 or is fully separated from the lower drum head 3 when such is desired, making it more difficult to play this kind of snare drum 1 so as to achieve the desired sound effects.

FIGS. 12 and 13 illustrate one example of the structure of a conventional combination-type musical instrument which has been disclosed in U.S. Pat. No. 1,653,570. This combination-type musical instrument is made up of a percussion instrument mixed with a stringed instrument. FIG. 12 is a plan view of the mixed type of musical instrument and FIG. 13 is a cross-sectional view taken on the line A—A of FIG. 12. In FIGS. 12 and 13, the combination-type musical instrument has a shell 20, a bottom drum head 21, a top drum head 22, leg supports 23, and marginal drum head tension elements 24. Components 20 through 24, except the leg supports 23 in FIGS. 12 and 13, respectively, correspond to the drum body 1, the lower and upper drum heads 3, and components including the lugs 5 and the bolts 6 in FIG. 11. String anchor blocks 25 and 26 are mounted on diametrically opposite sides of the shell 20. A string anchor 27 is mounted on the string anchor block 25, to which each one end of a series of strings 28 through 31 is attached. Each another end of the strings 28 through 31 is connected to tuning posts 32 adjustable to be turned by keys 33 mounted in the string anchor block 26. In order to withstand the strain on the shell 20 due to the action of the strings 28 through 31, the shell 20 is braced with a strut 34 running parallel to, and midway of, the strings 28 through 31 and connected to the shell 20 at points opposite the center of the string anchor blocks 25 and 26. Bridges 35 through 38 are provided on the top drum head 22 in order that the strings 28 through 31 are supported on the top drum head 22 as a resonating body. The above-mentioned drum type of musical instrument is played by striking the strings 28 through 31 with a hammer, by picking, or by bowing according to the quantity of tone desired to be produced in the same way as a dulcimer or a cymbalon.

The above-mentioned conventional combination-type musical instrument is played in the same way as the dulcimer or the cymbalon of which the strings are, for example, struck with the hammer, but is not played in the same way as a snare drum in which the upper drum head is struck with drumsticks. In the above-mentioned conventional combination-type musical instrument, the tuning posts 32 are adjustable to be turned by the keys 33. However, the keys 33 are used for adjusting the tension of the strings 28 through 31 between the bridges, but not used for changing timbres during performance. Therefore, the strings 28 through 31 are not provided so that they move into contact with or away from the outer surface of the top drum head 22 during performance.

SUMMARY OF THE INVENTION

In consideration of the above described problems, it is an object of the present invention to provide a snare drum having parallel snares uniformly mounted by parallel closely spaced strainers which has high quality sound production and performance characteristics, and which is capable of fully applying a rich snare sound effect to drum sounds produced thereby.

So as to achieve the above-described object, the present invention provides a snare drum having a hollow cylindrical drum body having an outer surface, upper and lower drum heads fitted over respective openings formed at upper and lower ends of the drum body at peripheral edges of the upper and lower drum heads, upper and lower rims, each of which engages a peripheral edge of a corresponding one of the upper and lower drum heads, a plurality of lugs arranged around the outer surface of the drum body, a plurality of nuts which connect said upper and lower rims with the plurality of the lugs so as to pull the upper and lower rims toward one another, thereby applying and maintaining centrifugally directed tension to the upper and lower drum heads along the peripheral edges thereof, a plurality of snares, a plurality of snare strainers provided on the drum body, the snare strainers having a movable section which can be made to operate so as to adjust one of the plurality of the snares attached thereto so that one of the plurality of the snares can be moved between a position in which one of the plurality of the snares is in contact with a surface of a drum head and a position in which one of the plurality of said snares is out of contact with the drum head, and means for mounting a pair of the plurality of the snare strainers in proximity to opposite sides of two of the plurality of the lugs, such that the two lugs are lugs from among the plurality of the lugs which lie on opposite ends of a line segment which approximately superimposes a diameter of the drum body, one of the two lugs being coupled by a first one of the plurality of the nuts to a selected location on the lower rim and the means for mounting being coupled to the selected location on the lower rim by the first one of the plurality of the nuts to generally space the pair of the snare strainers on opposite sides of the one of the two lugs in generally parallel relation to each other.

Furthermore, the present invention provides a snare drum having a hollow cylindrical drum body having an outer surface, upper and lower drum heads fitted over respective openings formed at upper and lower ends of the drum body at peripheral edges of the upper and lower drum heads, upper and lower rims, each of which engages a peripheral edge of a corresponding one of the upper and lower drum heads, a plurality of lugs arranged around the outer surface of the drum body, a plurality of nuts which connect the upper and lower rims with the plurality of the lugs so as to pull the upper and lower rims toward one another, thereby applying and maintaining centrifugally directed tension to the upper and lower drum heads along the peripheral edges thereof, a plurality of snares, a plurality of snare strainers provided on the drum body, the snare strainers having a movable section which can be made to operate so as to adjust one of the plurality of the snares attached thereto so that one of the plurality of the snares can be moved between a position in which one of the plurality of the snares is in contact with a surface of one of the upper and lower drum head and a position in which one of the plurality of the snares is out of contact with one of the upper and lower drum heads, and mounting means including bases for mounting the snare strainers on the outer surface of the drum body so as to lie parallel to a diameter of the one of the upper and lower drum heads, wherein the snare strainers are mounted on the drum body and include a pair of snare strainers in proximity to opposite sides of two of the plurality of the lugs, such that the two lugs are lugs from among the plurality of the lugs which lie on opposite ends of a line segment which approximately superimposes a diameter of the drum body, the bases including a base extending transversely between the pair of snare strainers.

According to the present invention, snares can be provided in the proximity of a diameter of the drum body, even tension is applied around the periphery of the drum head, and sound which is clear and sharp can be uniformly produced.

DETAILED DESCRIPTION OF THE PREFERRED EMBODIMENTS

Figure 1:
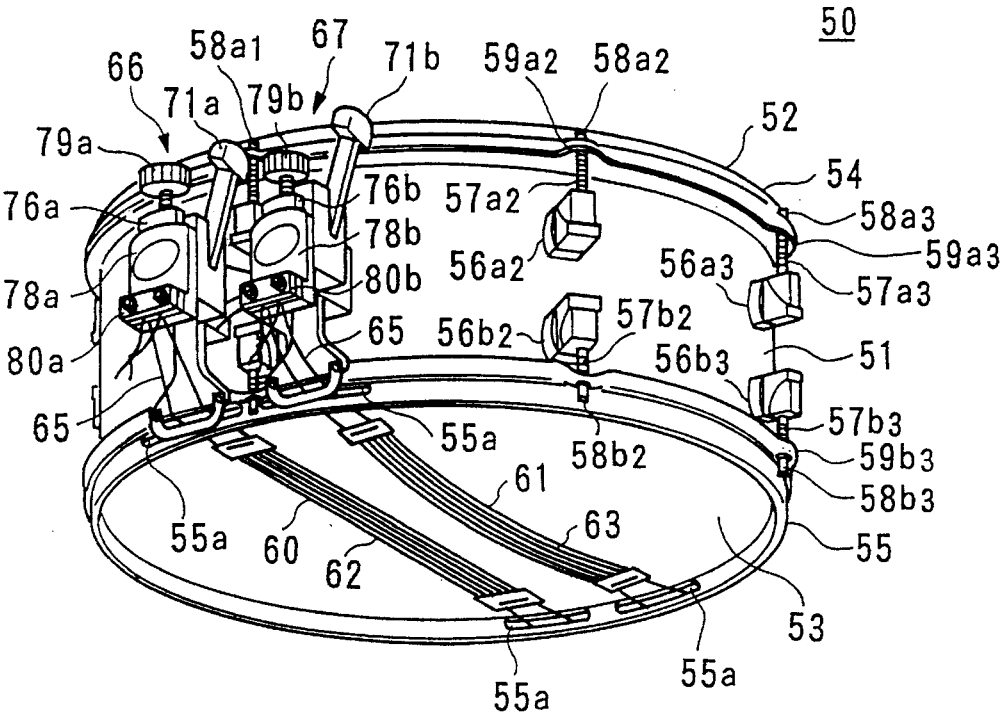
FIG. 1 is an oblique view illustrating the structure of a snare drum based on the preferred embodiment of the present invention.
Figure 2:
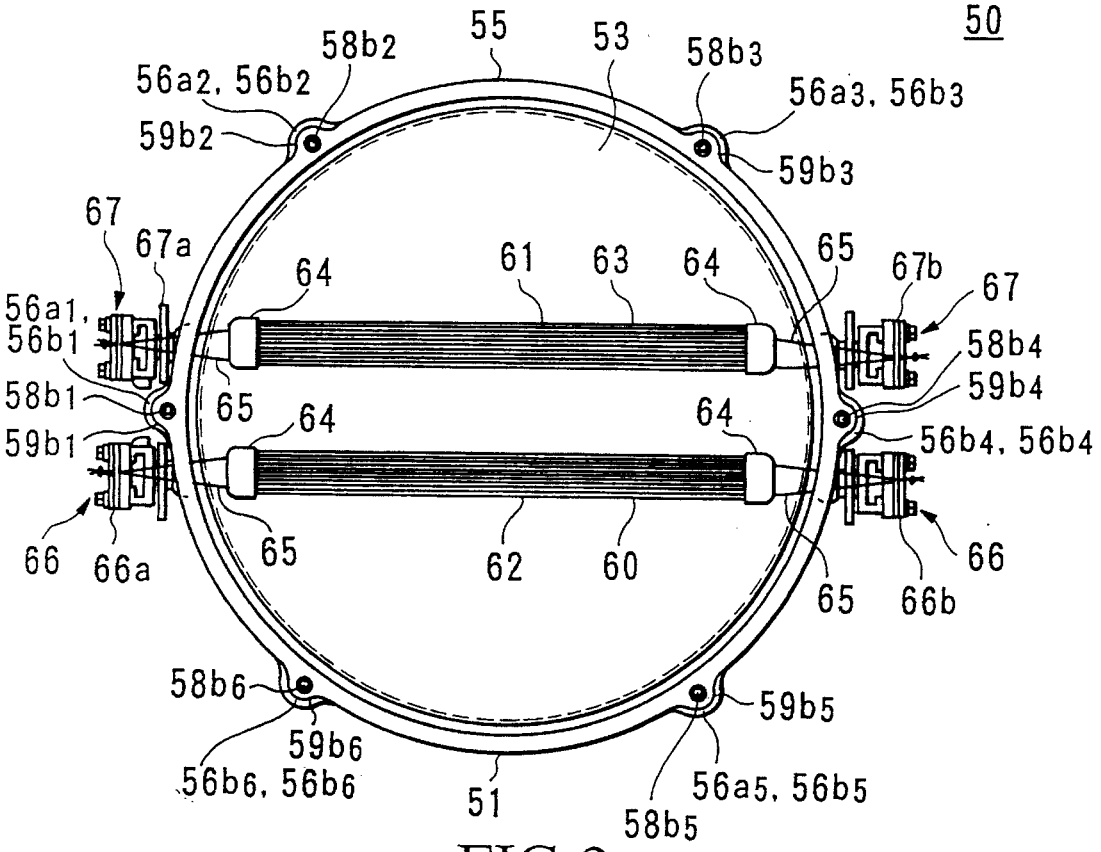
FIG. 2 is a bottom view illustrating the structure of a snare drum based on the preferred embodiment of the present invention.
Figure 3:
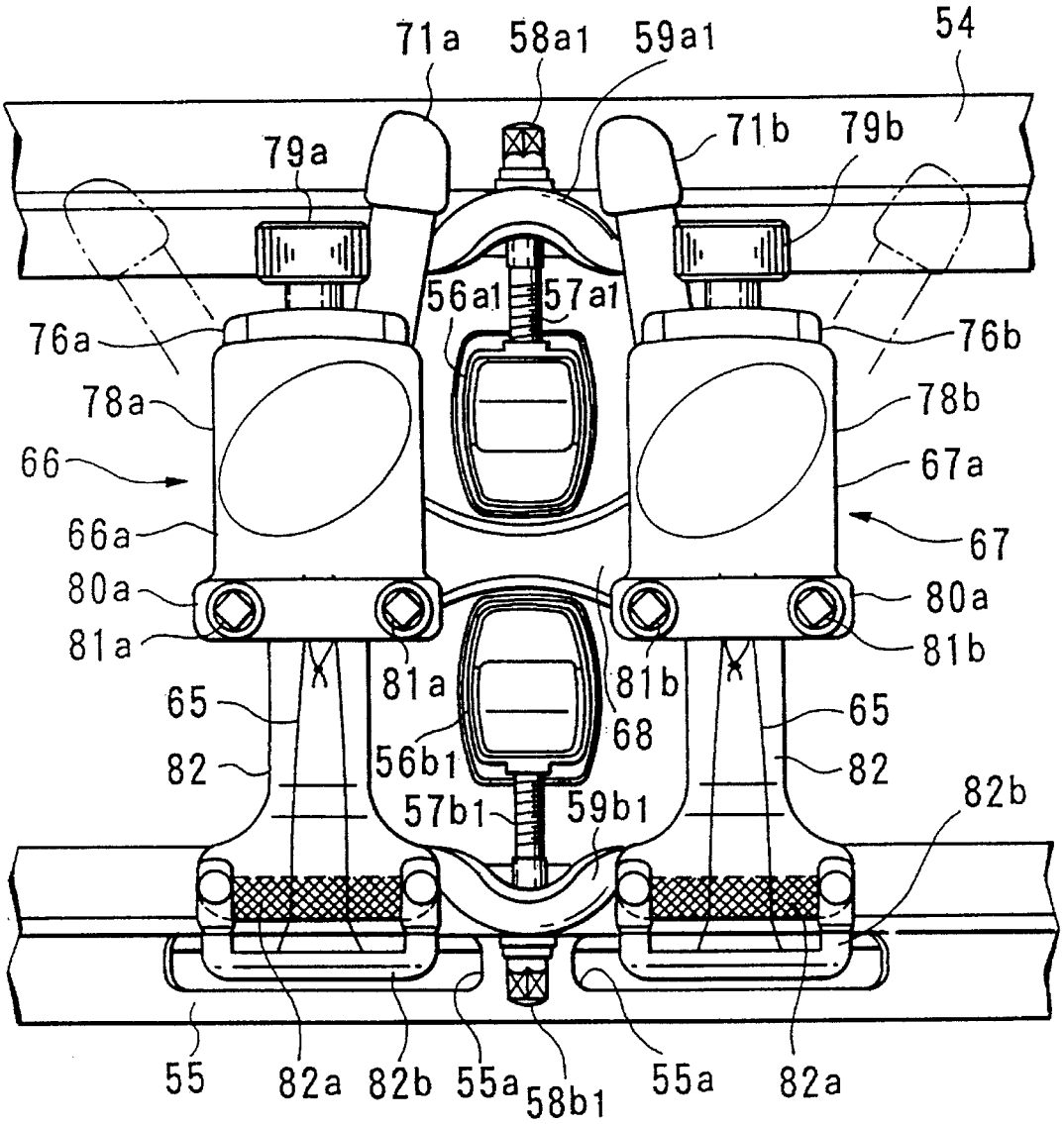
FIG. 3 is a left side structural view illustrating the snare drum shown in FIG. 1.
Figure 4:
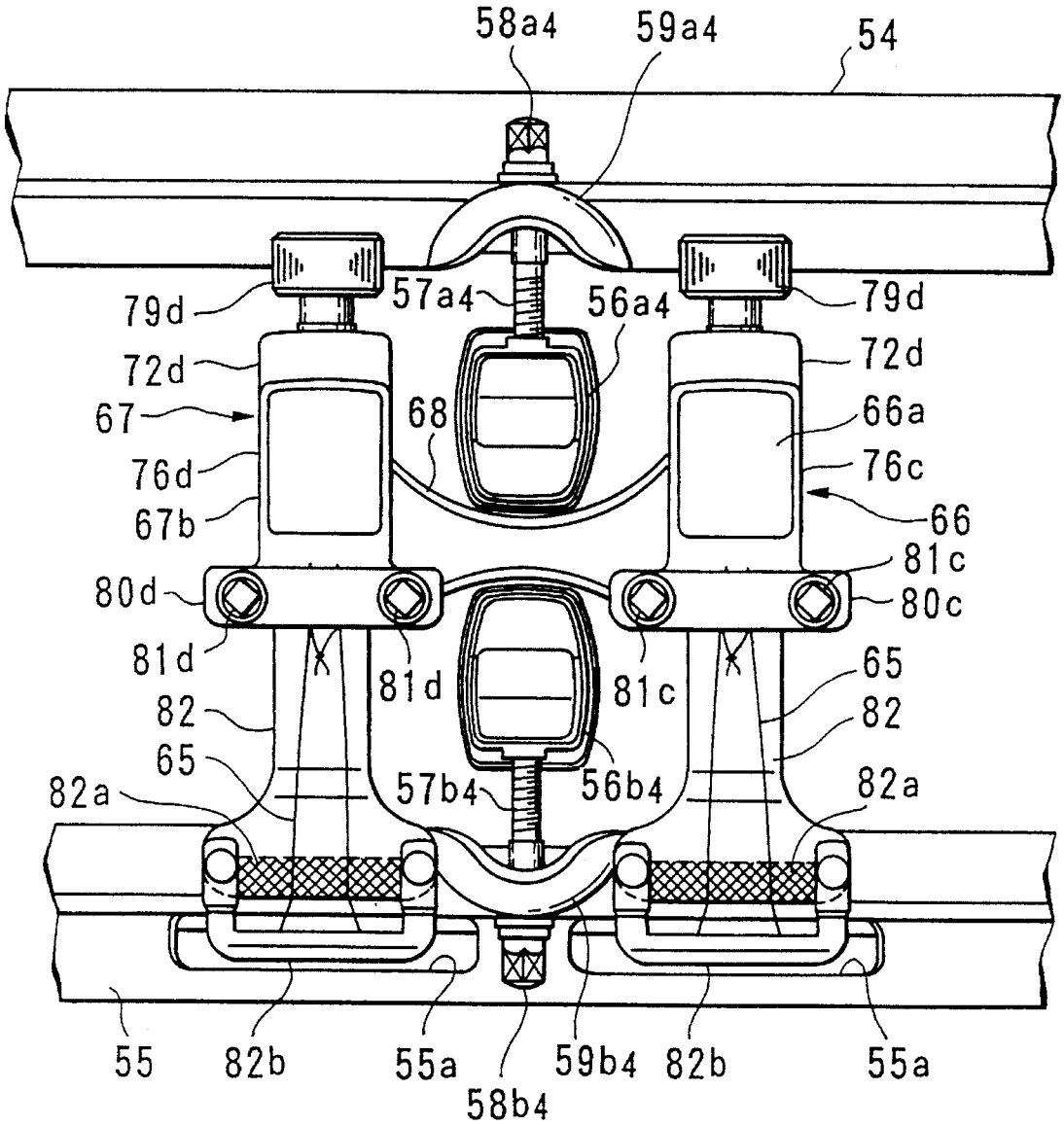
FIG. 4 is a right side structural view illustrating the snare drum shown in FIG. 1.

In the following, a preferred embodiment of the present invention will be described with reference to the drawings. FIG. 1 shows an oblique view of a snare drum 50 based on the preferred embodiment of the present invention. Furthermore, the lower surface, left side and right side of the snare drum 50 are shown in FIGS. 2, 3 and 4 respectively. In these drawings, the snare drum 50 includes a hollow cylindrical drum body 51, upper and lower drum heads 52 and 53 fitted over the openings formed at the upper and lower ends of the drum body 51. Upper and lower rims 54 and 55 are provided which engage the peripheral edge of the upper and lower drum heads 52 and 53, respectively, on the upper and lower peripheral edges of the drum body 51 using lugs $\mathbf{56}_{a1}$ through $\mathbf{56}_{a6}$ and lugs $\mathbf{56}_{b1}$ through $\mathbf{56}_{b6}$, bolts $\mathbf{57}_{a1}$ through $\mathbf{57}_{a6}$ and bolts $\mathbf{57}_{b1}$ through $\mathbf{57}_{b6}$, and nuts $\mathbf{58}_{a1}$ through $\mathbf{58}_{a6}$ and nuts $\mathbf{58}_{b1}$ through $\mathbf{58}_{b6}$. The lugs $\mathbf{56}_{a1}$ through $\mathbf{56}_{a6}$ and lugs $\mathbf{56}_{b1}$ through $\mathbf{56}_{b6}$ are distributed along the outer circumferential surface of the drum body 51, such that the longitudinal axis of each lug $\mathbf{56}_{a1}$–$\mathbf{56}_{a6}$ and $\mathbf{56}_{b1}$–$\mathbf{56}_{b6}$ lies approximately parallel to the longitudinal axis of the drum body 51. As can be appreciated from FIGS. 3 and 4, each lug $\mathbf{56}_{a1}$ through $\mathbf{56}_{a6}$ originates near the edge of the upper end of the drum body 51, extending centrally such that the end thereof approaches the end of a corresponding lug from among lugs $\mathbf{56}_{b1}$ through $\mathbf{56}_{b6}$ which similarly extend centrally from near the edge of the lower end of the drum body 51. The bolts $\mathbf{57}_{a1}$ through $\mathbf{57}_{a6}$ are projected from one end of a corresponding lug among the lugs $\mathbf{56}_{a1}$ through $\mathbf{56}_{a6}$ toward the edge of the upper end of the drum body 51, respectively, and are upwardly projected through holes formed in a corresponding projection among the projection $\mathbf{59}_{a1}$ through $\mathbf{59}_{a6}$ which are circumferentially spaced on the upper rim 54. The nuts $\mathbf{58}_{a1}$ through $\mathbf{58}_{a6}$ are engaged with a corresponding projected bolt among the bolts $\mathbf{57}_{a1}$ through $\mathbf{57}_{a6}$ by means of a thread formed around the bolts $\mathbf{57}_{a1}$ through $\mathbf{57}_{a6}$ and a threaded hole formed in the nuts $\mathbf{58}_{a1}$ through $\mathbf{58}_{a6}$. The bolts $\mathbf{57}_{b1}$ through $\mathbf{57}_{b6}$ are projected from one end of a corresponding lug among the lugs $\mathbf{56}_{b1}$ through $\mathbf{56}_{b6}$ toward the edge of the lower end of the drum body 51, respectively, and are downwardly projected through holes formed in a corresponding projection among the projection $\mathbf{59}_{b1}$ through $\mathbf{59}_{b6}$ which are circumferentially spaced on the lower rim 55. The nuts $\mathbf{58}_{b1}$ through $\mathbf{58}_{b6}$ are engaged with a corresponding projected bolt among the bolts $\mathbf{57}_{b1}$ through $\mathbf{57}_{b6}$ by means of a thread formed around the bolts $\mathbf{57}_{b1}$ through $\mathbf{57}_{b6}$ and a threaded hole formed in the nuts $\mathbf{58}_{b1}$ through $\mathbf{58}_{b6}$. By means of this arrangement, each lug $\mathbf{56}_{a1}$–$\mathbf{56}_{a6}$ and $\mathbf{56}_{b1}$–$\mathbf{56}_{b6}$ and corresponding of the bolts $\mathbf{57}_{a1}$–$\mathbf{57}_{a6}$ and $\mathbf{57}_{b1}$–$\mathbf{57}_{b6}\mathbf{6}$ and corresponding of the nuts $\mathbf{58}_{a1}$–$\mathbf{58}_{a6}$ and $\mathbf{58}_{b1}$–$\mathbf{58}_{b6}$ act to pull the upper and lower rims 54 and 55 toward one another, thereby applying and maintaining centrifugally directed tension to the upper and lower drum heads 52 and 53 along the peripheral edges thereof.

The snare drum 50 further includes snares 60 and 61 which run across the lower end of the drum 50 in an approximately parallel relationship with respect to one another and in an approximately parallel relationship with a diameter of the snare drum 50, and in proximity to the outer surface of the lower drum head 53. The snares 60 and 61 are each constructed from a snare element 62 or 63, respectively, consisting of multiple parallel strands of gut string and the like, a metal retainer 64 at each end of each of the snare element 62 or 63, and a braid 65 for each metal retainer 64 whereby each metal retainer 64 is connected with drum body 51 via a corresponding snare strainer 66 or 67, respectively.

The two braids 65 at the ends of the snare 60 and those at the ends of the snare 61 each connect with the outer surface of the drum body 51 via a corresponding snare strainer 66 or 67 after first passing through a corresponding opening $\mathbf{55}_a$ for each provided in the lower rim 55.

At each of two approximately diametrically opposing positions along the outer circumferential surface of the drum body 51, the pair of the snare strainers 66 and 67 are provided in an orientation approximately parallel to that of lugs $\mathbf{56}_{a1}$–$\mathbf{56}_{a6}$ and $\mathbf{56}_{b1}$–$\mathbf{56}_{b6}$. As is best shown in FIGS. 3 and 4, opposing lugs $\mathbf{56}_{a1}$ and $\mathbf{56}_{b1}$ lie between the pair of the snare strainers 66 and 67 at one side of the drum body 51, and opposing lugs $\mathbf{56}_{a4}$ and $\mathbf{56}_{b4}$ lie between the pair of the snare strainers 66 and 67 at the opposite side of the drum body 51. As shown in FIGS. 2 and 3, the braid 65 which is attached to the left end of the snare 60 and the braid 65 which is attached to the left end of the snare 61 each connect with lever sides $\mathbf{66}_a$ and $\mathbf{67}_a$ of the snare strainers 66 and 66, respectively. Similarly, and as is shown in FIGS. 2 and 4, the braid 65 which is attached to the right end of the snare 60 and the braid 65 which is attached to the right end of the snare 61 each connect with butt sides $\mathbf{66}_b$ and $\mathbf{67}_b$ of the snare strainers 66 and 67, respectively.

Figure 5:
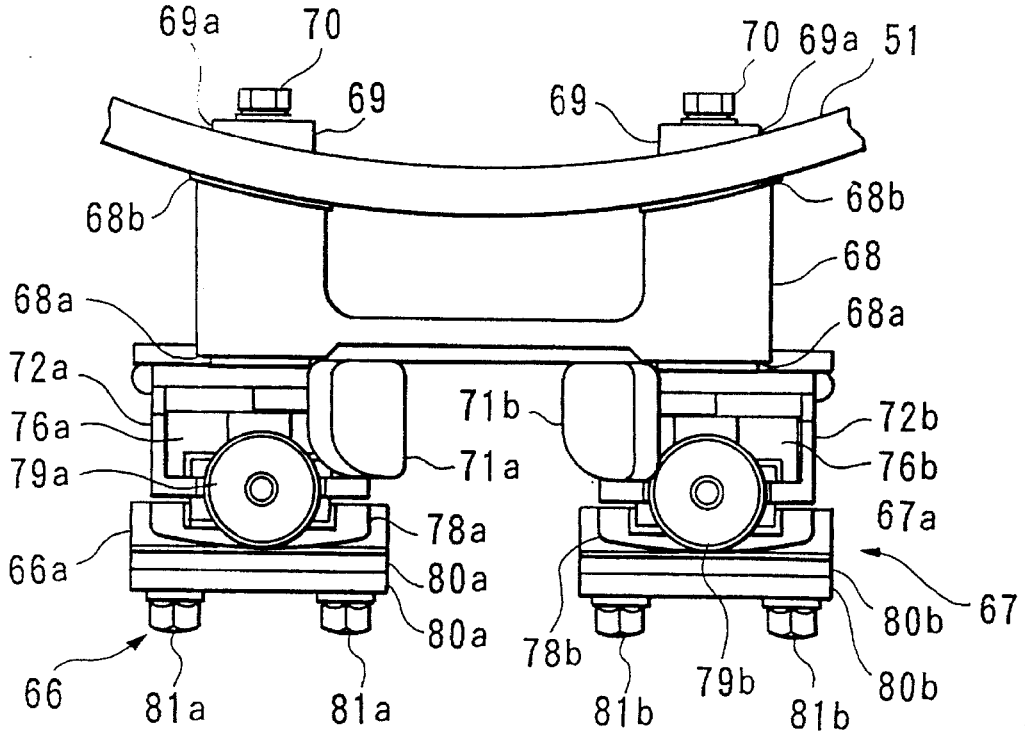
FIG. 5 is a top view illustrating lever sides $\mathbf{66}_a$ and $\mathbf{67}_a$ of snare strainers 66 and 67 forming the snare drum shown in FIG. 1.
Figure 6:
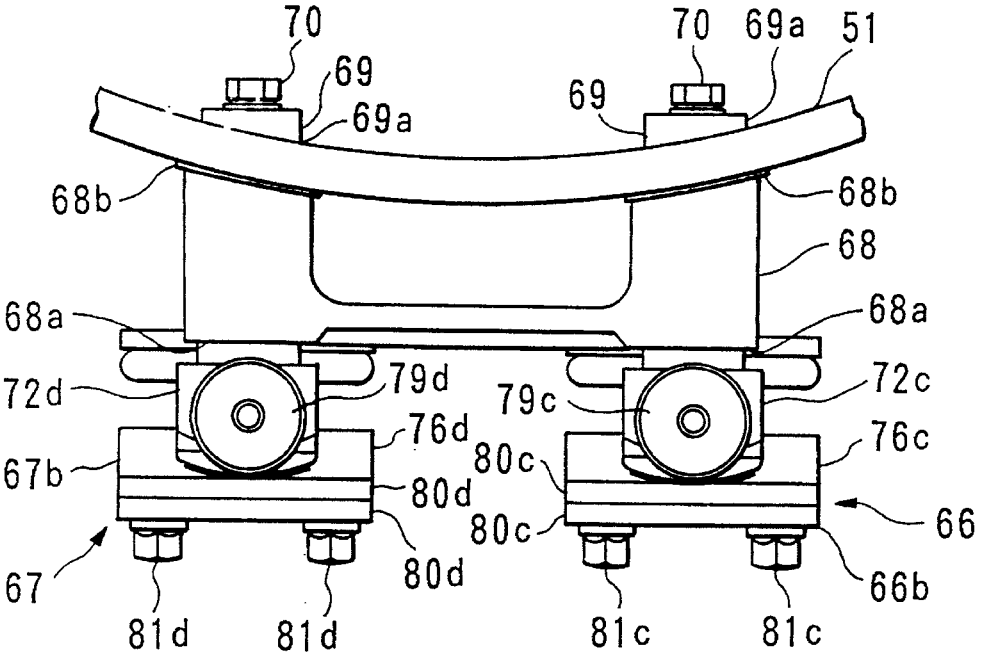
FIG. 6 is a top view illustrating butt sides $\mathbf{66}_b$ and $\mathbf{67}_b$ of snare strainers 66 and 67 forming the snare drum shown in FIG. 1.
Figure 8:
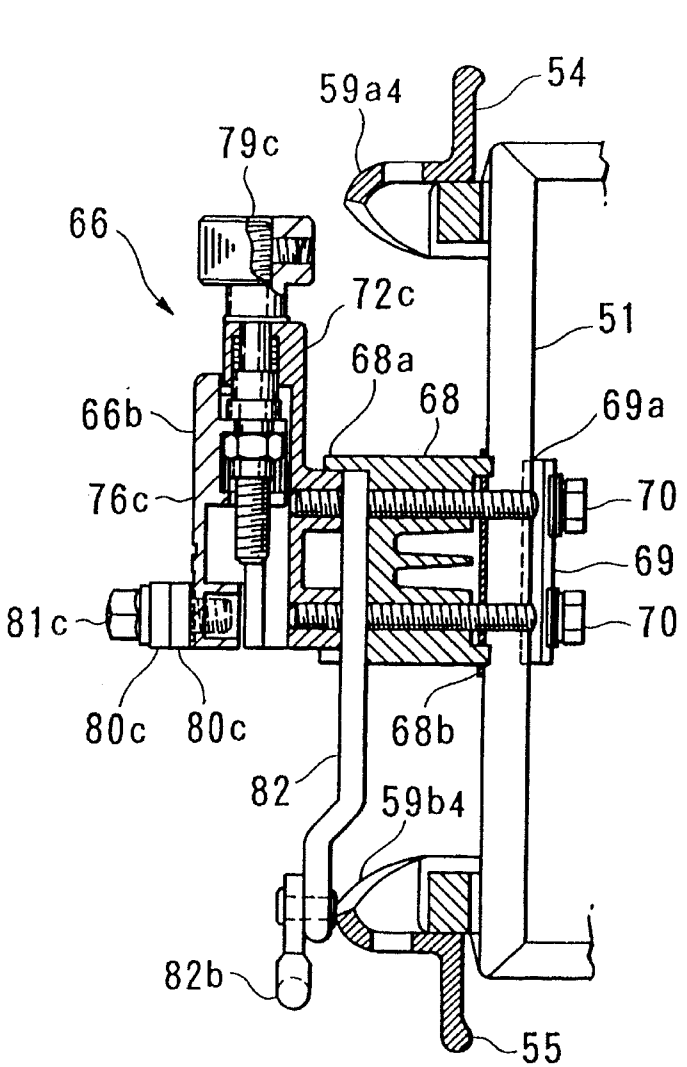
FIG. 8 is a partial longitudinal section view illustrating butt sides $\mathbf{66}_b$ and $\mathbf{67}_b$ of snare strainers 66 and 67 forming the snare drum shown in FIG. 1.
Figure 7:
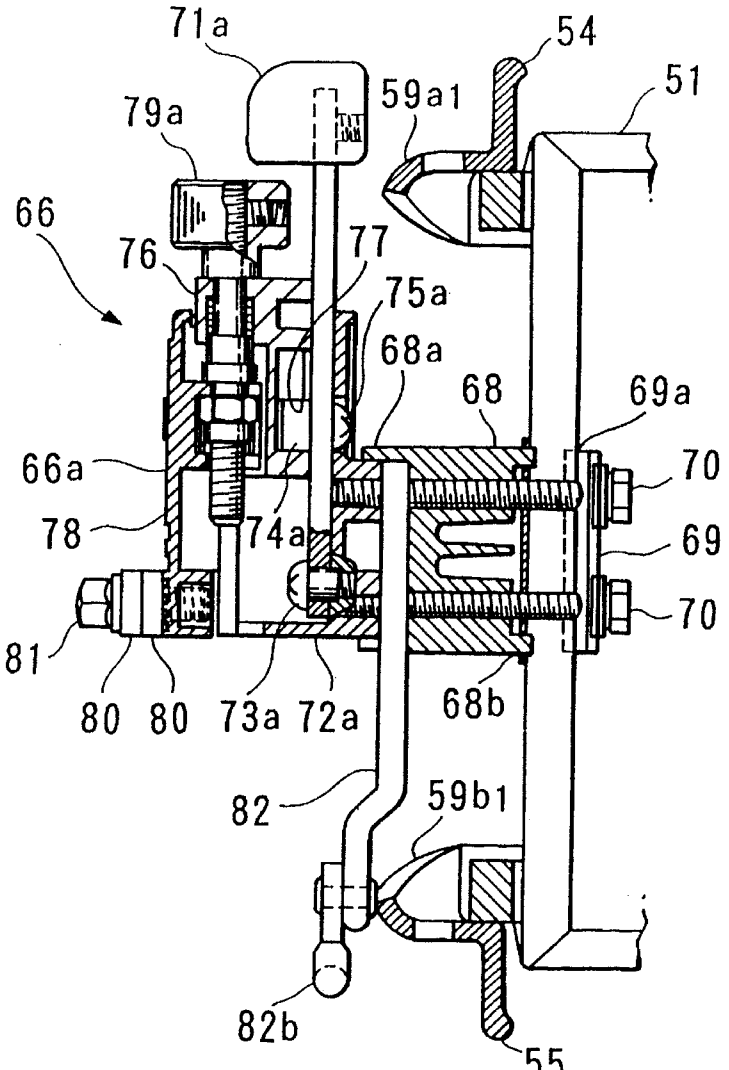
FIG. 7 is a partial longitudinal section view illustrating lever sides $\mathbf{66}_a$ and $\mathbf{67}_a$ of snare strainers 66 and 67 forming the snare drum shown in FIG. 1.
Figure 10:
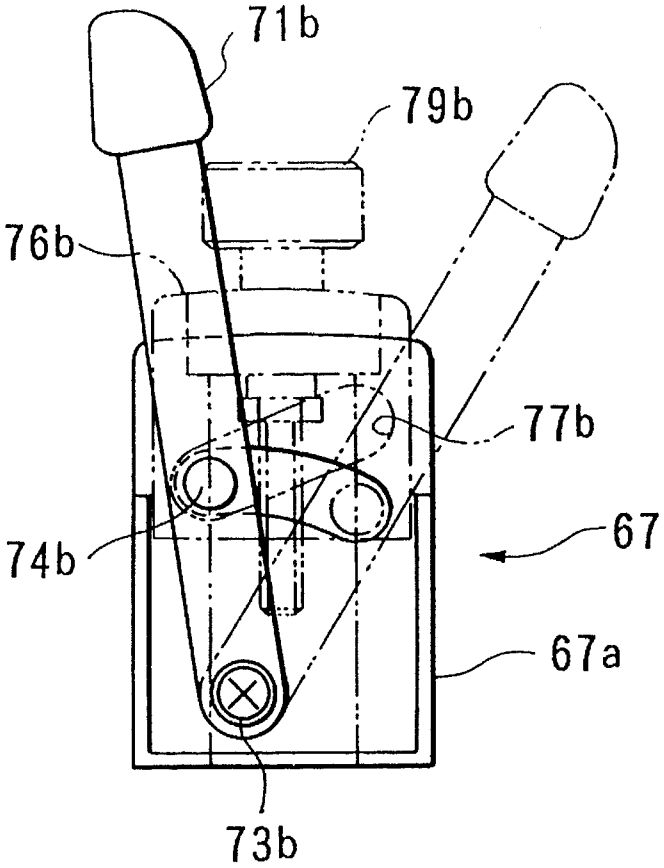
FIG. 10 is a diagram representing the operation of the lever side $\mathbf{67}_a$ of the snare strainer 67 shown in FIG. 3.
Figure 9:
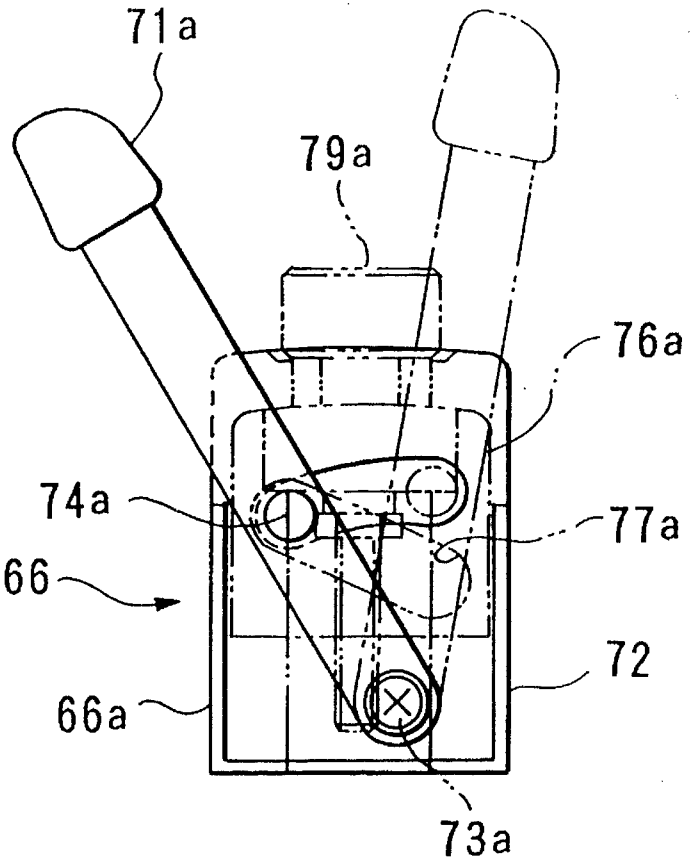
FIG. 9 is a diagram representing the operation of the lever side $\mathbf{66}_a$ of the snare strainer 66 shown in FIG. 3.
Figure 11:
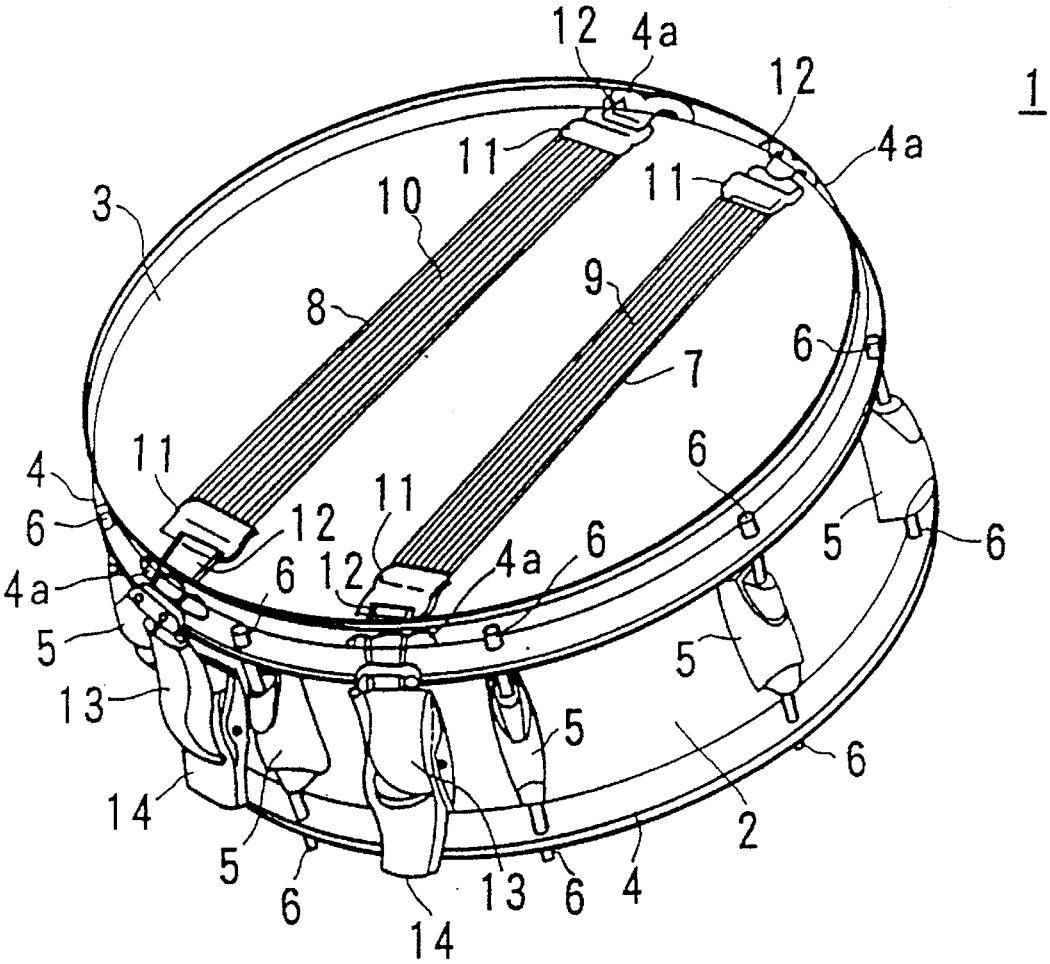
FIG. 11 (PRIOR ART)
FIG. 11 is an oblique view of a conventional snare drum.
Figure 12:
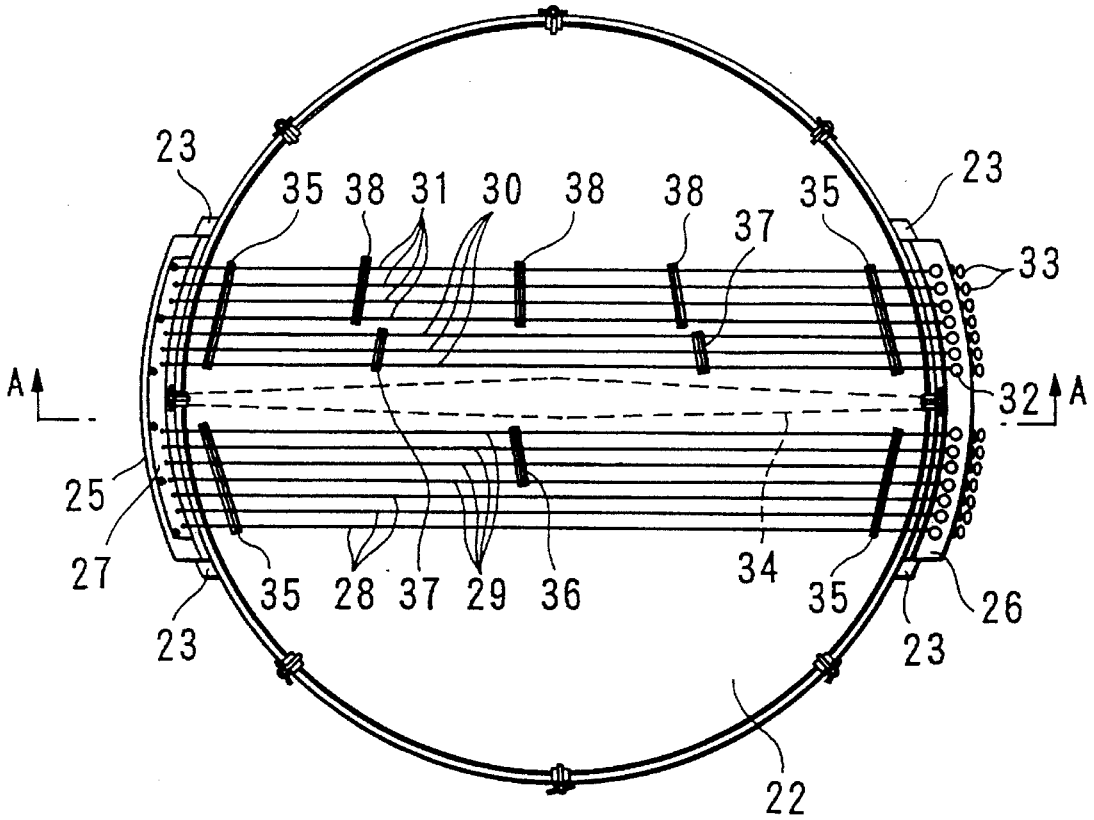
FIG. 12 (PRIOR ART)
FIG. 12 is a plan view of a conventional mixed type of musical instrument.
Figure 13:
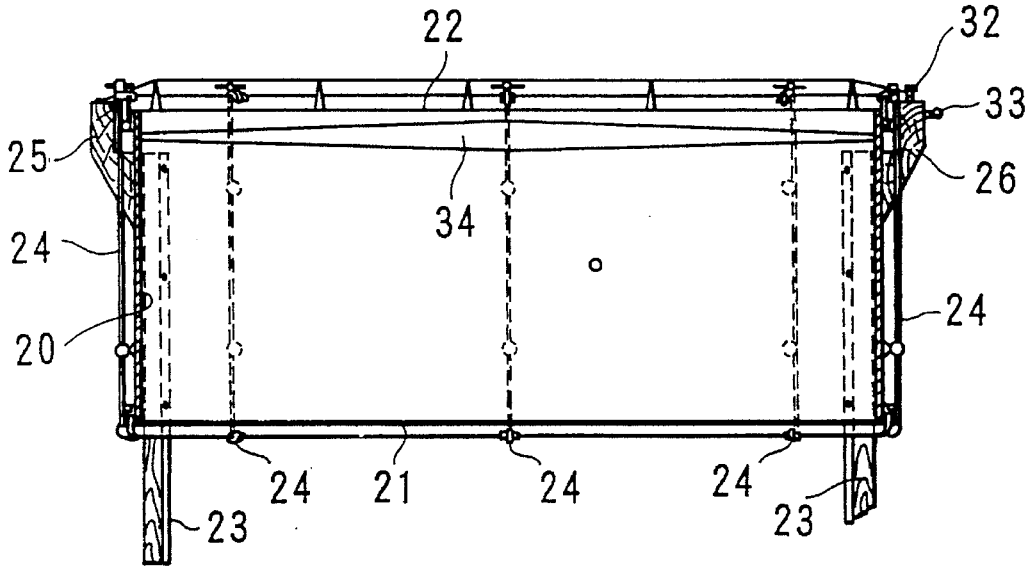
FIG. 13 (PRIOR ART)
FIG. 13 is a cross-sectional view taken on the line A—A of FIG. 12.

As is shown in FIGS. 3 through 8, bases 68 are provided, by means of which the snare strainers 66 and 67 are mounted on the outer surface of the drum body 51 so as to lie parallel to a diameter of the lower drum head 53 and to be in a substantially parallel relationship to one another. In FIGS. 5 and 6, the upper rim 54, the lugs $\mathbf{56}_{a1}$, $\mathbf{56}_{a4}$, $\mathbf{56}_{b1}$, and $\mathbf{56}_{b4}$, the bolts $\mathbf{57}_{a1}$, $\mathbf{57}_{a4}$, $\mathbf{57}_{b1}$, and $\mathbf{57}_{b4}$, and the nuts $\mathbf{58}_{a1}$, $\mathbf{58}_{a4}$, $\mathbf{58}_{b1}$, and $\mathbf{58}_{b4}$ are not drawn so as to clearly represent the connected relation between the drum body 51 and the base 68. In FIGS. 7 and 8, the lugs $\mathbf{56}_{a1}$, $\mathbf{56}_{a4}$, $\mathbf{56}_{b1}$, and $\mathbf{56}_{b4}$, the bolts $\mathbf{57}_{a1}$, $\mathbf{57}_{a4}$, $\mathbf{57}_{b1}$, and $\mathbf{57}_{b4}$, and the nuts $\mathbf{58}_{a1}$, $\mathbf{58}_{a4}$, $\mathbf{58}_{b1}$, and $\mathbf{58}_{b4}$ are not drawn for the same reason as was the case in FIGS. 5 and 6. Each part of the snare strainers 66 and 67 is inserted in each recess formed on each one side $\mathbf{68}_a$ of the bases 68. Each of the other sides $\mathbf{68}_b$ of the bases 68 are formed so that almost all of the surfaces of the other sides $\mathbf{68}_b$ of the bases 68 can be contacted with the outer circumferential surface of the drum body 51. The bases 68 are connected to the drum body 51 by means of fitting members 69 and bolts 70. Each one side $\mathbf{69}_a$ of the fitting members 69 are formed so that almost all of the surfaces of each one side $\mathbf{69}_a$ of the fitting members 69 can be contacted with an inner circumferential surface of the drum body 51. The bolts 70 are engaged with the bases 68 through each hole formed in the drum body 51 and the fitting members 69 by means of a thread formed around the bolts 70 and a threaded hole in the bases 68. Each surface of one side $\mathbf{68}_b$ of the bases 68 and one side $\mathbf{69}_a$ of the fitting members 69 is flat and is parallel to one another, and is orthogonal to the diameter of the drum body 51.

In FIGS. 1, 3, 5, 7, 9, and 10, the lever sides $\mathbf{66}_a$ and $\mathbf{67}_a$ of the snare strainers 66 and 67 are provided with rotatable levers $\mathbf{71}_a$ and $\mathbf{71}_b$ whereby the position of the snare elements 62 and 63 of the snares 60 and 61, respectively, can each be independently adjusted relative to the outer surface of the lower drum head 53, thereby making it possible to move one or both of the snare elements 62 and 63 into contact with, or moved away from, the outer surface of the lower drum head 53. In this way, it is possible to generate two or more different types of sound with the snare drum 50. In FIGS. 3, 7, 9, and 10, levers $\mathbf{71}_a$ and $\mathbf{71}_b$ are rotatably fixed on strainer bodies $\mathbf{72}_a$ and $\mathbf{72}_b$ by means of screws $\mathbf{73}_a$ and $\mathbf{73}_b$ as a shaft. At one side of the approximate mid-position of the levers $\mathbf{71}_a$ and $\mathbf{71}_b$, rollers $\mathbf{74}_a$ and $\mathbf{74}_b$ are rotatably secured by screws $\mathbf{75}_a$ and $\mathbf{75}_b$ inserted from the other side of the lever $\mathbf{71}_a$ and $\mathbf{71}_b$ and move in tracks $\mathbf{77}_a$ and $\mathbf{77}_b$ formed in sliders $\mathbf{76}_a$ and $\mathbf{76}_b$ with their own rotation by rotating the levers $\mathbf{71}_a$ and $\mathbf{71}_b$. Accordingly, the sliders $\mathbf{76}_a$ and $\mathbf{76}_b$ are vertically moved by rotating the levers $\mathbf{71}_a$ and $\mathbf{71}_b$. Furthermore, in FIGS. 3, 5, 7, 9, and 10, snare fitting members $\mathbf{78}_a$ and $\mathbf{78}_b$ are secured at each lower part of the sliders $\mathbf{76}_a$ and $\mathbf{76}_b$ by means of adjustment bolts $\mathbf{79}_a$ and $\mathbf{79}_b$ and a threaded hole formed in the snare fitting members $\mathbf{78}_a$ and $\mathbf{78}_b$. Each of the braids 65 is attached at each lower part of the snare fitting members $\mathbf{78}_a$ and $\mathbf{78}_b$ by being pinched between the snare fitting members $\mathbf{78}_a$ and $\mathbf{78}_b$ and plates $\mathbf{80}_a$ and $\mathbf{80}_b$ using bolts $\mathbf{81}_a$ and $\mathbf{81}_b$. By rotating the adjustment bolts $\mathbf{79}_a$ and $\mathbf{79}_b$, the position of the snare fitting members $\mathbf{78}_a$ and $\mathbf{78}_b$ can be adjusted upward and downward, thereby adjusting the tension applied to the snares 60 and 61. In FIGS. 4, 6, and 8, at the butt sides $\mathbf{66}_b$ and $\mathbf{67}_b$ of the snare strainers 66 and 67 are provided snare bodies $\mathbf{72}_c$ and $\mathbf{72}_d$, sliders $\mathbf{76}_c$ and $\mathbf{76}_d$, adjustment bolts $\mathbf{79}_c$ and $\mathbf{79}_d$, plates $\mathbf{80}_c$ and $\mathbf{80}_d$, and bolts $\mathbf{81}_c$ and $\mathbf{81}_d$, which correspond to and have the same structures and the same functions as the strainer bodies $\mathbf{72}_a$ and $\mathbf{72}_b$, the sliders $\mathbf{76}_a$ and $\mathbf{76}_b$, the adjustment bolts $\mathbf{79}_a$ and $\mathbf{79}_b$, the plates $\mathbf{80}_a$ and $\mathbf{80}_b$, and the bolts $\mathbf{81}_a$ and $\mathbf{81}_b$ of the lever sides $\mathbf{66}_a$ and $\mathbf{67}_a$ of the snare strainers 66 and 67, respectively. Furthermore, the sliders $\mathbf{76}_c$ and $\mathbf{76}_d$ also have structures and functions which the snare fitting members of the lever sides $\mathbf{66}_a$ and $\mathbf{67}_a$ have, respectively.

In FIGS. 3, 4, 7, and 8, the snare guides 82 are inserted between bases 68 and the strainer bodies $\mathbf{72}_a$ through $\mathbf{72}_d$ so as to maintain the snares 60 and 61 in a parallel relationship with the diameter of the lower drum head 53. The position of the snare guides 82 is not affected by upward or downward movement of the snare strainers 66 and 67 effected by the adjustment bolts $\mathbf{79}_a$ through $\mathbf{79}_d$. The snare guides 82 are provided with smooth edges $\mathbf{82}_a$ made of Teflon (polytetrafluoroethylene) or the like over which corresponding braids 65 run, and with braid retainers $\mathbf{82}_b$ to prevent the braids 65 from passing beyond their corresponding snare guides 82 when the levers $\mathbf{71}_a$ and $\mathbf{71}_b$ are operated so as to move the snares 60 and 61 away from the lower drum head 53.

With the snare drum 50 of the embodiment of the present invention as thus described, when a performer moves the lever $\mathbf{71}_a$ of the snare strainer 67 from the position indicated by the broken line in FIG. 3 to that indicated by the solid line, the lever side $\mathbf{66}_a$ of the snare strainer 66 moves upward, bringing the snare element 62 into full contact with the surface of the lower drum head 53. When the performer, for example, moves the lever $\mathbf{71}_b$ of the snare strainer 67 from the position indicated by the solid line in FIG. 3 to that indicated by the broken line, the lever side $\mathbf{67}_a$ of the snare strainer 67 moves downward, moving the snare element 63 completely away from the surface of the lower drum head 53, the corresponding braid retainers $\mathbf{82}_b$ preventing the braid 65 from continuing beyond the snare guide 82.

Because the snares 60 and 61 of the snare drum 50 of this embodiment are In close proximity, the parallel relationship to one another in proximity to and parallel with the diameter of the lower drum head 53, simultaneous or independent operation of each of the levers $\mathbf{71}_a$ and $\mathbf{71}_b$ of corresponding snare strainers 66 and 67, respectively, can rapidly and easily be carried out during the course of a performance. By providing the snares 60 and 61 which apply differing timbre characteristics when in contact with the lower drum head 53, simple manipulation of the levers $\mathbf{71}_a$ and $\mathbf{71}_b$ during a performance permits generation of drum sound having multiple freely selectable timbres.

Furthermore, the close proximity of the snare strainers 66 and 67 to the intervening lugs 56 on each side permits the openings $\mathbf{55}_a$ in the lower rim 55 to similarly lie in close proximity to the intervening lugs 56, thereby enhancing mechanical strength of the lower rim 55, in this way permitting finely controlled adjustment of the tension on the bolts 58 around the lower rim 55 so as to attain highly uniform tension applied to the upper and lower drum heads 52 and 53 around their periphery.

Provision of the base 68 allows the snare strainers 66 and 67 to have a smaller total height along the surface of the drum body 51. When the levers $\mathbf{71}_a$ and $\mathbf{71}_b$ are both rotated in toward the lugs $\mathbf{56}_{a1}$ and $\mathbf{56}_{b1}$, the snare elements 62 and 63 move smoothly into full contact with the lower drum head 53, whereas when the levers $\mathbf{71}_a$ and $\mathbf{71}_b$ are both rotated outward, the snare elements 62 and 63 both move smoothly and completely away from the surface of the lower drum head 53. For these reasons, simple operation of the snares 60 and 61 is easily conducted during a performance using only one hand.

In the present embodiment, the snare strainers 66 and 67 are joined on each side by means of the previously described base 68. The base 68 is not a limiting feature of the present invention, and can be dispensed with as long as the strainers 66 and 67 are mounted in a close parallel relationship with the diameter of the lower drum head 53. It should be noted, however, that inclusion of the bases 68 provides added stability, and also simplifies manufacture of this type of snare drum.

What is claimed is:

1. A snare drum comprising:

a hollow cylindrical drum body having an outer surface;

upper and lower drum heads fitted over respective openings formed at upper and lower ends of said drum body at peripheral edges of the upper and lower drum heads;

upper and lower rims, each of which engages said peripheral edge of a corresponding one of said upper and lower drum heads;

a plurality of lugs arranged around the outer surface of said drum body and each having a bolt extending through one or the other of said upper and lower rims;

a plurality of nuts mounted on said bolts to connect said upper and lower rims with the plurality of said lugs so as to pull said upper and lower rims toward one another, thereby applying and maintaining centrifugally directed tension to said upper and lower drum heads along the peripheral edges thereof;

a plurality of snares extending across said lower drum head;

a plurality of snare strainers provided on said drum body, with each of the snare strainers having a movable section coupled to one of the plurality of said snares to move said one of said plurality of said snares between a position in which said one of the plurality of said snares is in contact with a surface of said lower drum head and a position in which said one of the plurality of said snares is out of contact with said lower drum head in response to movement of said movable section; and mounting means including a base for mounting a pair of the plurality of said snare strainers in proximity to opposite sides of two of the plurality of lugs, the base being mounted on the outer surface of said drum body between said two of the plurality of lugs and having said pair of the plurality of said snare strainers mounted on opposite ends of the base;

the mounting means further including a pair of elongated guides mounted on the opposite ends of the base adjacent different ones of said pair of the plurality of said snare strainers, the pair of elongated guides being generally equidistantly spaced from said two of the plurality of lugs on opposite sides thereof and lying generally within a common plane so as to dispose the pair of snare strainers within a common plane and being generally parallel to each other.

2. A snare drum in accordance with claim 1, further including second mounting means including a second base for mounting a second pair of the plurality of said snare strainers in proximity to opposite sides of another two of the plurality of lugs on an opposite side of the drum body from said pair of the plurality of said snare strainers, the second base being mounted on the outer surface of said drum body between said another two of the plurality of lugs and having said second pair of the plurality of said snare strainers mounted on opposite ends of the second base, the second mounting means further including a second pair of elongated guides mounted on the opposite ends of the second base adjacent different ones of said second pair of the plurality of said snare strainers, the second pair of elongated guides being generally equidistantly spaced from said another two of the plurality of lugs on opposite sides thereof and lying generally within a common plane so as to dispose the second pair of snare strainers within a common plane.

3. A snare drum in accordance with claim 1, wherein the base is comprised of a pair of opposite, spaced-apart portions coupled to and extending outwardly from the drum body on opposite sides of said two of the plurality of lugs and joined by a connecting member therebetween, each of the pair of opposite, spaced-apart portions mounting a different one of the pair of elongated guides adjacent an outer end so that the elongated guide extends downwardly therefrom and mounting a different one of the pair of snare strainers at the outer end thereof so that the snare strainer extends upwardly therefrom.

4. A snare drum comprising:

a cylindrical drum body having upper and lower drum heads mounted on opposite ends thereof;

a pair of snare strainer assemblies mounted on the drum body on opposite sides thereof; and a pair of snares extending across the lower drum head between the pair of snare strainer assemblies;

each of the pair of snare strainer assemblies including a base mounted on an outer surface of the drum body, a pair of elongated, generally planar guides mounted adjacent opposite ends of the base so as to be disposed in generally parallel, spaced-apart relation and generally within a common plane and so as to present a pair of spaced-apart elongated openings lying generally within the common plane and adjacent an edge of the lower drum head, a pair of adjustable snare strainers mounted at the opposite ends of the base so as to be disposed in generally parallel, spaced-apart relation and generally within the common plane, and braids coupling one end of each of the pair of snares to a different one of the pair of snare strainers through the elongated opening in a different one of the pair of elongated guides.

5. A snare drum in accordance with claim 4, wherein the common planes of the pair of snare strainer assemblies on opposite sides of the drum body are generally parallel to each other.

6. A snare drum in accordance with claim 4, further including upper and lower rims engaging peripheral edges at the upper and lower drum heads respectively and opposite pairs of lugs, each mounted on the drum body adjacent a different one of the pair of snare strainer assemblies, each of the opposite pairs of lugs having an upper lug mounted above the base of the adjacent snare strainer assembly and coupled to the upper rim and a lower lug mounted below the base of the adjacent snare strainer assembly so that the upper and lower lugs are disposed generally equidistantly between the pair of elongated guides and the pair of snare strainers of the adjacent snare strainer assembly.

* * * * *